US010488042B2

(12) United States Patent
Yang et al.

(10) Patent No.: US 10,488,042 B2
(45) Date of Patent: Nov. 26, 2019

(54) METHOD FOR DETECTING BLOCKAGE IN EXHAUST FLUE OF GAS BOILER

(71) Applicant: KYUNGDONG NAVIEN CO., LTD, Pyeongtaek-si, Gyeonggi-do (KR)

(72) Inventors: Dong Jin Yang, Yeosu-si (KR); Jeon Hur, Seoul (KR); Soo Hyun Hur, Seoul (KR)

(73) Assignee: KYUNGDONG NAVIEN CO., LTD, Pyeongtaek-si, Gyeonggi-do (KR)

( * ) Notice: Subject to any disclaimer, the term of this patent is extended or adjusted under 35 U.S.C. 154(b) by 522 days.

(21) Appl. No.: 15/305,600

(22) PCT Filed: Apr. 13, 2015

(86) PCT No.: PCT/KR2015/003681
§ 371 (c)(1),
(2) Date: Oct. 20, 2016

(87) PCT Pub. No.: WO2015/163620
PCT Pub. Date: Oct. 29, 2015

(65) Prior Publication Data

US 2017/0038068 A1 Feb. 9, 2017

(30) Foreign Application Priority Data

Apr. 22, 2014 (KR) ..... 10-2014-0048197

(51) Int. Cl.
*F23N 5/24* (2006.01)
*F23N 5/10* (2006.01)
*F23N 5/20* (2006.01)

(52) U.S. Cl.
CPC ..... *F23N 5/245* (2013.01); *F23N 5/10* (2013.01); *F23N 5/20* (2013.01)

(58) Field of Classification Search
CPC ..... F23N 5/20; F23N 5/245; F23N 2025/18; F23N 2025/19; F24H 9/2007
(Continued)

(56) References Cited

U.S. PATENT DOCUMENTS 6,401,708 B1 * 6/2002 Kim ..... F23N 5/242 126/116 A
8,662,885 B2 * 3/2014 Roland ..... F23N 3/002 110/193
(Continued)

FOREIGN PATENT DOCUMENTS

JP 63-189712 A 8/1998
JP 2000-274678 A 10/2000
(Continued)

*Primary Examiner* — Gregory L Huson
*Assistant Examiner* — Nikhil P Mashruwala
(74) *Attorney, Agent, or Firm* — Novick, Kim & Lee, PLLC; Jae Youn Kim

(57) ABSTRACT

The present invention relates to a method for detecting a blockage in an exhaust flue of a gas boiler, comprising: (A) a step for conducting an ignition process according to a user set temperature requested from the outside and performing temperature control to reach the user set temperature; (B) a step for determining whether the current fan RPM of a driven blower exceeds a reference fan RPM; (C) a step for calculating a difference between temperature values of supplied heating water and collected heating water that are detected by temperature sensors when heating water is supplied and determining whether the calculated value is less than a preset reference temperature value when it is determined that the current fan RPM exceeds the reference fan RPM; (D) a step for determining whether the elapsed time elapses a preset setting time based on the determination time point of the step (C) when it is determined that the calculated value is less than the reference temperature value; and (E) a step for displaying, on the outside, a notification
(Continued)

that the blockage in the exhaust flue has been identified when it is determined that the elapsed time has elapsed the setting time based on the determination time point of the step (C).

5 Claims, 3 Drawing Sheets

(58) Field of Classification Search
USPC ..... 431/2
See application file for complete search history.

(56) References Cited

U.S. PATENT DOCUMENTS

| | | | | |
|---|---|---|---|---|
| 9,453,648 | B2 * | 9/2016 | Schultz | F23N 5/00 |
| 9,879,859 | B2 * | 1/2018 | Kusachi | F23N 1/042 |
| 2007/0207420 | A1 * | 9/2007 | Zimmermann | F23N 5/003 431/22 |
| 2010/0095905 | A1 * | 4/2010 | Smelcer | F23D 14/02 122/14.2 |
| 2014/0060458 | A1 * | 3/2014 | Fujimoto | F24H 9/2035 122/14.3 |
| 2014/0080075 | A1 * | 3/2014 | Young | F23N 1/022 431/76 |
| 2017/0292698 | A1 * | 10/2017 | Langius | F23N 1/022 |
| 2018/0274782 | A1 * | 9/2018 | Schmiederer | F23N 1/022 |

FOREIGN PATENT DOCUMENTS

| | | | | |
|---|---|---|---|---|
| JP | 2000274678 | A | * | 10/2000 |
| KR | 10-1997-0002195 | A | | 1/1997 |
| KR | 10-0512494 | B1 | | 10/2005 |
| KR | 10-2011-0032751 | A | | 3/2011 |
| KR | 10-2011-0045653 | A | | 5/2011 |
| KR | 10-1318759 | B1 | | 10/2013 |
| WO | 2012053681 | A1 | | 4/2012 |

* cited by examiner

METHOD FOR DETECTING BLOCKAGE IN EXHAUST FLUE OF GAS BOILER

TECHNICAL FIELD

The present invention relates to a method for detecting a blockage in an exhaust flue of a gas boiler and, specifically, to a method for detecting a blockage in an exhaust flue of a gas boiler which can detect blockage in an exhaust flue by using blower fan RPM and a difference between temperatures of supplied heating water and collected heating water.

BACKGROUND OF THE INVENTION

In general, a gas boiler is a device which internally combusts liquefied petroleum gas (LPG) or liquefied natural gas (LNG) or city gas, heats water using the combustion heat generated during this combustion process, and using the circulation pump heats indoors by circulating the heated water through the indoor heating pipe, or supplies hot water to the bathroom or the kitchen.

Furthermore, the gas boiler is divided into condensing and non-condensing type according to the heat exchanger heating the heating water. Among these the condensing gas boiler uses the combustion heat to directly heat the heating water, and can also maximize thermal efficiency by reabsorbing the latent heat of condensation of the exhaust gas.

Referring to the operation of the condensing gas boiler, first, high temperature heating water heated by the combustion heat of the burner is circulated to the heating pipe by the operation of the circulation pump, and the low temperature heating water collected by passing through the heating pipe is introduced into the latent heat exchanger, and the low temperature heating water introduced into the latent heat exchanger is preheated through heat exchange with exhaust gas which has passed through the sensible heat exchanger. This preheated heating water repeats the step of flowing again into the sensible heat exchanger to be directly heated by the combustion heat of the burner, and then circulating to the heating pipe by the operation of the circulation pump as described above. In addition, by the operation of the three-way valve installed on the outlet of the heat exchanger, the water heated by the burner is circulated to the heating pipe or sent to the hot water heat exchanger to carry out heat exchange with cold water supplied through the direct water pipe and be provided as hot water.

Meanwhile, such a conventional gas boiler may have unburned gas present at the combustion chamber during initial ignition, thus the burner is operated after rotating the exhaust fan at high speed to emit the unburned gas in the combustion chamber, in order to prevent explosion ignited by the unburned gas. During this time it should be determined whether the revolutions per minute (RPM) of the exhaust fan rotating at high speed is normal. This is because the exhaust fan RPM is the standard for determining blockage in an exhaust flue, or detecting headwind flowed in or drawn in through the exhaust flue. For this reason the exhaust fan RPM is detected and compared with the preset exhaust fan RPM. In this way, when determining blockage in an exhaust flue, during the process of confirming the operating conditions of a boiler by detecting the exhaust fan RPM, the reference fan RPM is preset and saved in the microcomputer, the exhaust fan RPM is detected during initial operation of the boiler and compared with the reference fan RPM, and if the detected RPM is determined to exceed the reference fan RPM, operation of the boiler is stopped and exhaust flue blockage error is displayed.

The exhaust flue blockage is detected as above since when the exhaust flue is blocked there is no gas, that is air flow discharged by the rotating exhaust fan, thereby the exhaust fan does not perform any action, and consequently, rotational speed of the exhaust fan is accelerated even when same operating voltage is applied. Furthermore, in the event of exhaust flue blockage or strong headwind, the mixing ratio of air and gas is inadequate, resulting in incomplete combustion which leads to a large amount of carbon monoxide in the exhaust gas and unburned gas being discharged, entailing a risk of poisoning accident.

Conventionally, most gas boilers have differential pressure sensors for detecting exhaust flue blockage or headwind, etc., or adopt the method of detecting exhaust flue blockage by comparing the blower RPM with the reference RPM, or comparing the current or voltage value applied to the blower with the reference value.

However, such a method of detecting blockage in an exhaust flue can often be the cause of increase in unit costs, misdetermine a normal state as blockage in the exhaust flue due to error in an individual blower and instability of current or voltage value applied to the blower, or is unable to properly detect blockage in the exhaust flue.

PRIOR ART

Patent Literature (Patent Literature 1) Korean Patent No. 10-0512494 (Method for sensing exhaust port closure of gas boiler; Aug. 29, 2005)

DISCLOSURE OF INVENTION

Technical Problem

The present invention has been made in view of the above problems, and aims to provide a method for detecting a blockage in an exhaust flue of a gas boiler which can detect a blockage in an exhaust flue by using a difference between temperatures of supplied heating water and collected heating water and the fan RPM during operation of the boiler, and uses this to accurately detect whether the exhaust flue is in a normal state or blocked state.

Technical Solution

The method for detecting a blockage in an exhaust flue of a gas boiler according to the present invention, which drives the blower according to the amount of air flowing through the venturi provided at the blower inlet when the boiler is activated and thereby introducing gas, conducts ignition process via the controller after an air-gas mixture is supplied to the burner, detects temperatures of supplied heating water and collected heating water during heating from the temperature sensors provided in the supplied heating water pipe and collected heating water pipe, and uses the blower fan RPM, and temperatures of supplied heating water and collected heating water to detect blockage in an exhaust flue, comprises (A) a step for conducting an ignition process according to a user set temperature and performing temperature control to reach the user set temperature; (B) a step for determining whether the current fan RPM of a driven blower exceeds a reference fan RPM; (C) a step for calculating a difference between temperature values of supplied heating water and collected heating water detected by temperature sensors when heating water is supplied and determining whether the calculated value is less than a preset reference temperature value, when it is determined that the current fan RPM exceeds the reference fan RPM; (D) a step for determining whether the elapsed time elapses a preset setting time based on the determination time point of the step (C) when it is determined that the calculated value is less than the reference temperature value; and (E) a step for displaying, on the outside, a notification that the blockage in the exhaust flue has been identified when it is determined that the elapsed time has elapsed the setting time based on the determination time point of the step (C).

The method for detecting a blockage in an exhaust flue of a gas boiler according to the present invention is characterized in that the reference fan RPM is the maximum fan RPM multiplied by 0.8.

The method for detecting a blockage in an exhaust flue of a gas boiler according to the present invention is characterized in that the setting time is 30 seconds.

The method for detecting a blockage in an exhaust flue of a gas boiler according to the present invention includes returning to step (B) and consecutively re-performing the steps, if the determination results of steps (B), (C) and (D) do not satisfy the conditions of each step.

The method for detecting a blockage in an exhaust flue of a gas boiler according to the present invention is controlled not to perform the sequence of detecting a blockage in an exhaust flue during the preset holding time, after the ignition process of step (A).

The method for detecting a blockage in an exhaust flue of a gas boiler according to the present invention includes a holding time of 30 seconds.

Advantageous Effects

The method for detecting blockage in an exhaust flue of a gas boiler of the present invention has the advantage of preventing blockage in an exhaust flue in a normal temperature control state, and can regularly detect blockage in an exhaust flue using the fan RPM and the difference between temperatures of supplied heating water and collected heating water.

In addition, since blockage in the exhaust flue can be detected using only the blower and the temperature sensors, which are generally provided in a gas boiler, blockage in the exhaust flue can be detected without having additional components such as separate exhaust pressure measuring device, thereby reducing costs.

DESCRIPTION OF THE PREFERRED EMBODIMENTS

Hereinafter, preferred embodiment of the present invention will be described in detail with reference to the accompanying drawings. Prior to this, the terms used in this specification and claims should not be construed to the limited standard or dictionary definition, and based on the principle that the inventor can suitably define the concept of the terms to describe their invention in the best way, should be understood as the definition and concept corresponding to the technical idea of the present invention.

Accordingly, the embodiment provided in the specification and the configurations shown in the figures are only a preferred embodiment of the present invention and do not represent all the technical ideas of the present invention, thus, it must be understood that various equivalents and modifications are possible to replace them at the time of filing this application.

Figure 1:
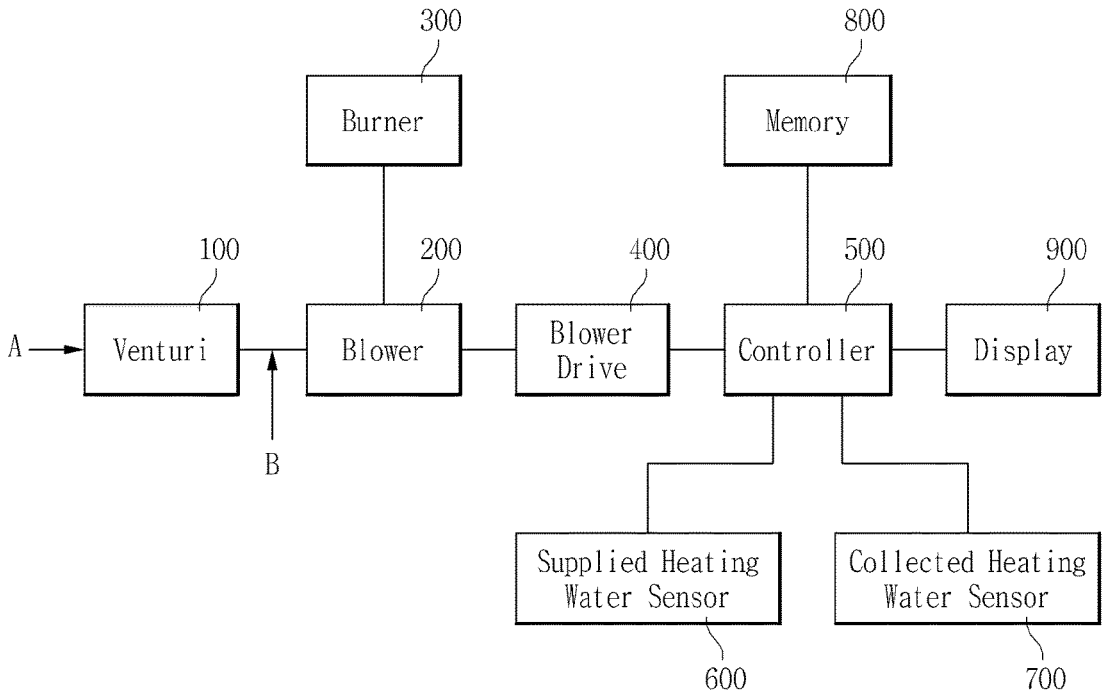
FIG. 1 is a block diagram showing control of a gas boiler applied with air proportional control method according to a preferred embodiment of the present invention.
Figure 2:
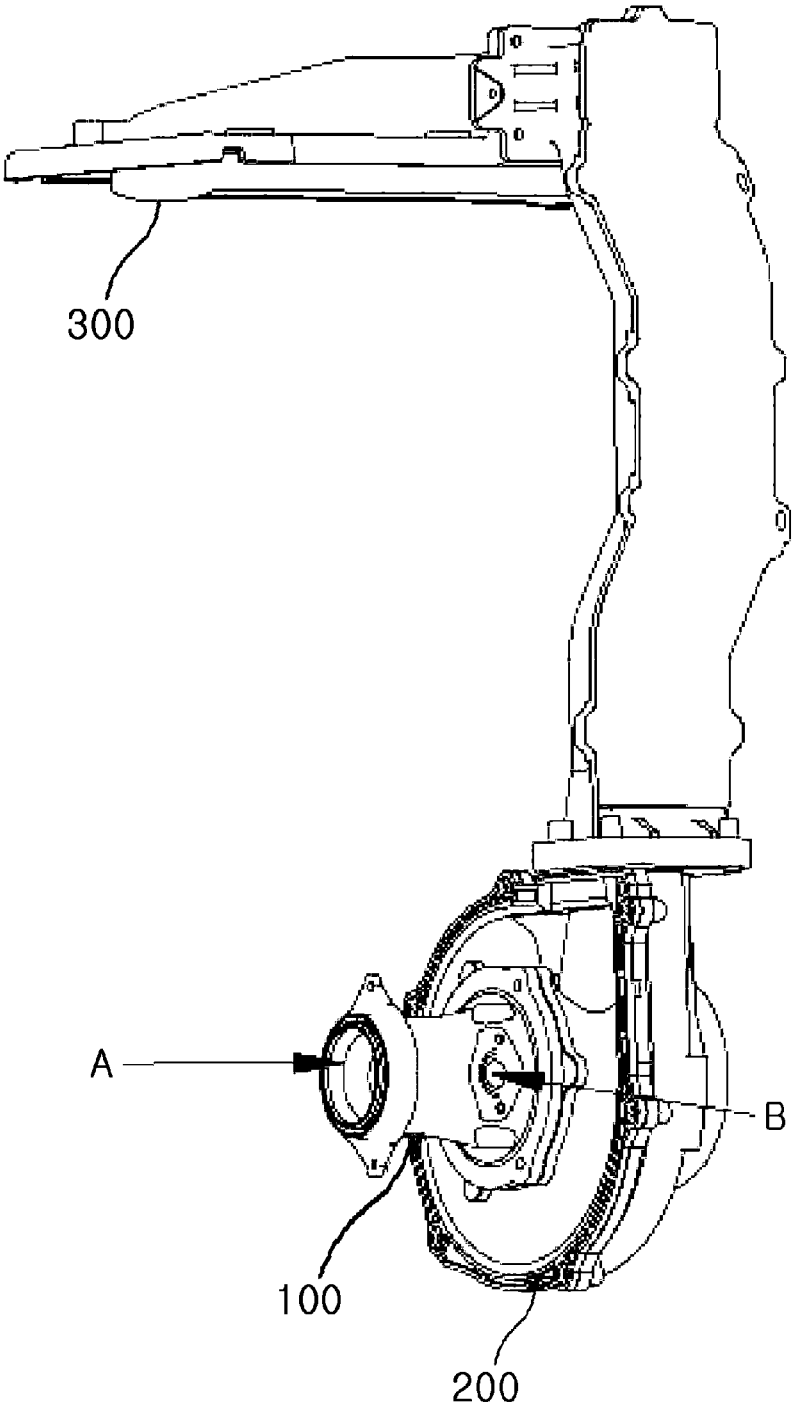
FIG. 2 is a view showing air and gas supply structure of the gas boiler applied with air proportional control method of FIG. 1.

In describing the configuration of a gas boiler of the present invention in detail with reference to FIGS. 1 and 2, the gas boiler may comprise a venturi (100), a blower (200), a burner (300), a blower drive (400), a controller (500), a supplied heating water sensor (600), a collected heating water sensor (700), memory (800) and a display (900).

When the boiler is operated by an external user inputting a set temperature, air (A) from outside is introduced through the venturi (100) provided at the inlet end of the blower (200), and the fan RPM of the blower (200) is adjusted by the blower drive (400) such that gas (B) flows in according to the amount of air introduced through the venturi (100). The air-gas mixture is supplied to the burner (300) through the blower (200) to perform the ignition process.

The controller (500) serves to control the overall sequence of actions that occur during the boiler operation. In addition, the controller (500) performs temperature control to reach the set temperature when the boiler is operated and the controller (500) performs normal ignition process. At this time, the boiler is controlled by the controller (500) so as to perform sequence of detecting a blockage in an exhaust flue in order to determine a blockage in an exhaust flue during the normal temperature control step.

The sequence of detecting a blockage in an exhaust flue consists of four steps including, a step determining whether holding time has been elapsed, a step determining whether a blower fan RPM exceeds a reference fan RPM, a step calculating the temperature difference (difference between temperatures of supplied heating water and collected heating water) to determine whether the calculated temperature difference value is less than a reference temperature value, and a step determining whether a setting time has been elapsed. The controller (500) is configured to determine each of the four steps in order, and also may further comprise a timer to determine elapsed time.

The supplied heating water sensor (600) is provided at the supplied heating water pipe (not shown) and detects the temperature of the supplied heating water, and the collected heating water sensor (700) is provided at the collected heating water pipe (not shown) and detects the temperature of the water collected after heating.

The memory (800) stores information required when the controller (500) performs sequence of detecting a blockage in an exhaust flue. For example, information on holding time, reference fan RPM, reference temperature value and setting time can be stored via external input.

The display (900) displays an error message confirming blockage in the exhaust flue per the request of the controller (500), when it is finally determined that there is blockage in the exhaust flue after performing the sequence of detecting a blockage in an exhaust flue by the controller (500).

Figure 3:
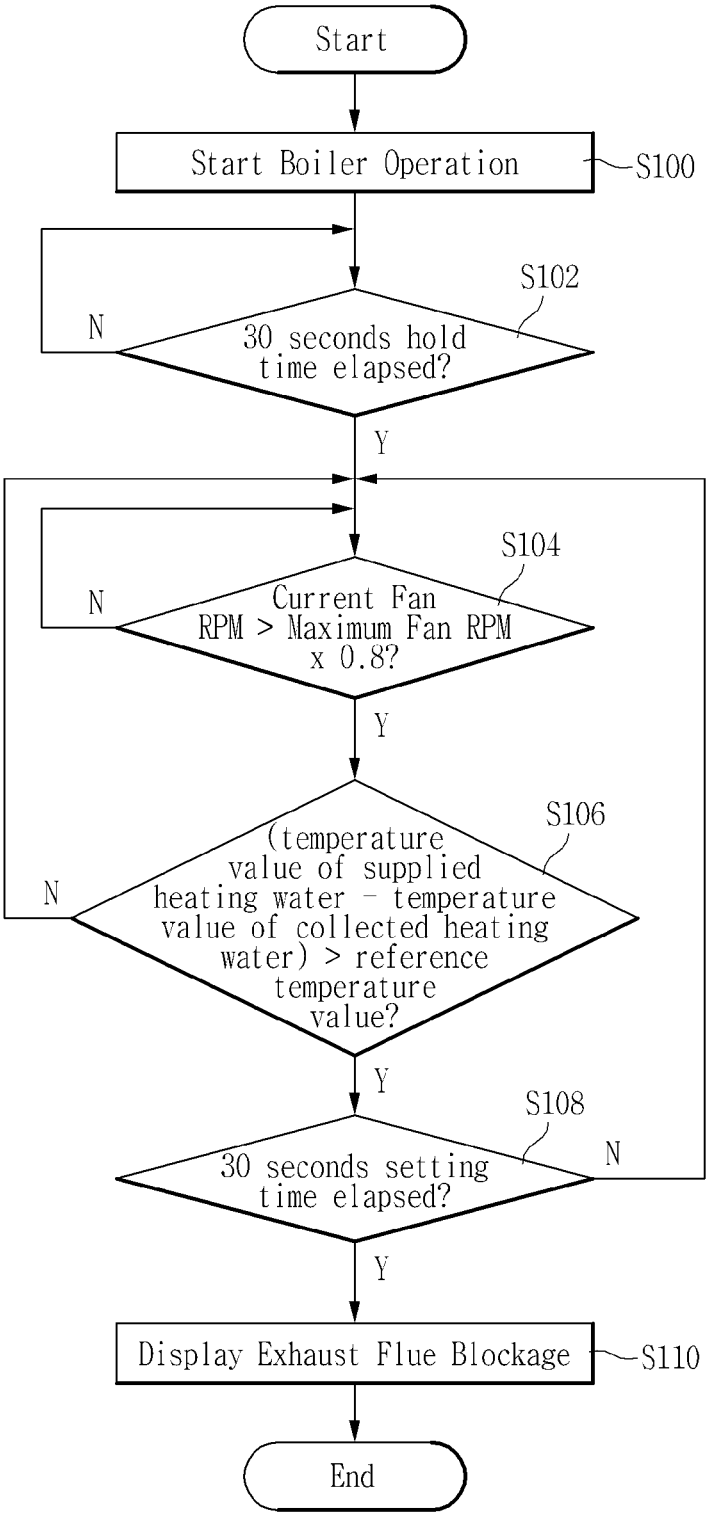
FIG. 3 is a flow chart showing a method for detecting a blockage in an exhaust flue of the gas boiler applied with air proportional control method according to a preferred embodiment of the present invention.

Hereafter, the method for detecting a blockage in an exhaust flue of a gas boiler of the present invention will be described with reference to FIG. 3.

First, when a set temperature is input by an external request and the boiler starts operating, ignition process is conducted and temperature control is performed to reach the set temperature (Step S100).

The sequence of detecting a blockage in an exhaust flue of a gas boiler is performed during temperature control, during which it is determined whether the holding time, for example 30 seconds, that was preset by the timer and saved has elapsed (Step S102).

The above step S102 defers the decision on the blockage in the exhaust flue until normal temperature is detected, since temperatures of the supplied heating water and the collected heating water change at the start of the ignition process. Here, the holding time can be set to 30 seconds, but this value may be changed depending on the circumstance, such as the degree of temperature change and boiler type.

When normal temperature is detected after 30 seconds, which was set as the holding time, has elapsed, the current fan RPM at the time of operating the blower (200) is preset and determined whether it exceeds the value of maximum fan RPM multiplied by 0.8, which corresponds to the stored reference fan RPM (Step S104). This is because the reference fan RPM is set as the value corresponding to 80% of the maximum fan RPM of the blower (200). Here, determining what percentage (%) of the maximum fan RPM to set as the value of the reference fan RPM is changeable according to the state, type of blower (200), precision of the controller (500) and the like.

If the determination conditions of Step S104 are met, difference between temperatures of supplied heating water and collected heating water is calculated, and it is determined whether the calculated value is less than a preset reference temperature value (Step S106). The difference between temperature values of supplied heating water and collected heating water is used because, when the air (A) flow passing through the venturi (100) is decreased according to the degree of blockage in the exhaust flue, input quantity of gas (B) is decreased, which results in the difference between temperature values of supplied heating water and collected heating water, and this difference can be used to detect blockage in the exhaust flue.

Furthermore, the reference temperature value can be selected by operating the boiler when blockage is not detected in the exhaust flue, adjusting the blower (200) fan RPM to the maximum and gradually blocking the exhaust, and then obtaining the value of temperature difference at a suitable blockage point by observing the combustion performance, carbon monoxide level, flame condition, etc. of the relevant boiler. The selected reference temperature value can be changed according to boiler capacity and the like.

If it is determined through Step S106 that the calculated value (difference between temperatures of supplied heating water and collected heating water) is less than the reference temperature value, the timer is checked to determine whether the preset setting time of 30 seconds has elapsed from this time point (Step S108). The setting time of 30 seconds may be changed for other conditions.

Finally an error message notifying blockage in the exhaust flue is displayed, when it is determined that the setting time of 30 seconds has elapsed upon checking with a timer (Step S110).

Alternatively, if the relevant conditions are not met at the holding time lapse determination step (Step S102), it is determined to be a normal detection state, and thereby returns to the previous step (Step S100) to continue performing temperature control so that the boiler is operated until the external user set temperature is reached.

In addition, when the current fan RPM of the driven blower does not exceed the reference fan RPM at the step of determining whether the current fan RPM exceeds the reference fan RPM (Step S104), or the difference between temperature values of supplied heating water and collected heating water is less than the preset reference temperature value at the step of determining whether the calculated temperature difference value is less than the reference temperature value (Step S106), or it is determined that the setting time has not been elapsed at the step of determining whether the setting time has elapsed (Step S108), each step returns to Step S104 and re-performs the steps from Step S104. From this the boiler, while operating, can regularly detect whether there is blockage in the exhaust flue.

[REFERENCE SIGNS]

| | |
|---|---|
| 100: Venturi | 200: Blower |
| 300: Burner | 400: Blower Drive |
| 500: Controller | 600: Supplied Heating Water Sensor |
| 700: Collected Heating Water Sensor | 800: Memory |
| 900: Display | A: Air |
| B: Gas | |

INDUSTRIAL APPLICABILITY

The present invention can be applied to a condensing gas boiler to prevent blockage in an exhaust flue during normal temperature control state, and regularly detect blockage in the exhaust flue during boiler operation by using the fan RPM and the difference between temperatures of supplied heating water and collected heating water.

The invention claimed is:

1. A method for detecting a blockage in an exhaust flue of a gas boiler, which drives a blower according to an amount of air flowing through a venturi provided at a blower inlet when the boiler is activated and thereby introduces gas, and conducts an ignition process via a controller after an air-gas mixture, which is a mixture of introduced gas and air, is supplied to a burner, wherein the controller detects temperatures of supplied heating water and collected heating water during heating by temperature sensors provided in a supplied heating water pipe and a collected heating water pipe, and uses a fan RPM of the blower and the temperatures of supplied heating water and collected heating water to detect the blockage in the exhaust flue, the method comprising, (A) a step for conducting, by the controller, the ignition process according to a user set temperature and performing temperature control to reach the user set temperature;

(B) a step for determining, by the controller, whether a current fan RPM of the blower exceeds a reference fan RPM which is set as a value less than a maximum fan RPM, after a holding time elapsed;

(C) a step for calculating, by the controller, a difference between temperature values of supplied heating water and collected heating water detected by the temperature sensors when heating water is supplied, and determining whether the difference is less than a reference temperature value, when it is determined that the current fan RPM exceeds the reference fan RPM, wherein the reference temperature value is determined by operating the gas boiler when the blockage is not detected in the exhaust flue, by adjusting the fan RPM of the blower, by gradually blocking the exhaust flue, and by obtaining a value of temperature difference between supplied heating water and collected heating water at a blockage point determined by observing combustion performance, a carbon monoxide level, and a flame condition of the gas boiler;

(D) a step for determining, by the controller, whether a preset time has elapsed from a time point in step (C) when it is determined that the difference is less than the reference temperature value; and (E) a step for displaying, by the controller, on a display, a notification that the blockage in the exhaust flue has been identified when it is determined that the preset time has elapsed.

2. The method of claim 1, wherein the reference fan RPM is set as a value corresponding to 80% of the maximum fan RPM.

3. The method of claim 1, wherein the preset time is 30 seconds.

4. The method of claim 1, wherein, when in step (B) the current fan RPM of the blower does not exceed the reference fan RPM, or in step (C) the difference between the temperature values of supplied heating water and collected heating water is less than the reference temperature value, or in step (D) it is determined that the setting time has not been elapsed, each step returns to step (B) and re-performs the steps in order.

5. The method of claim 1, wherein the holding time is 30 seconds.

* * * * *